United States Patent [19]

Mosig

[11] Patent Number: 4,590,888

[45] Date of Patent: May 27, 1986

[54] WATER HEATER

[75] Inventor: Ernst Mosig, Iffeldorf, Fed. Rep. of Germany

[73] Assignee: Webasto-Werk W. Baier GmbH & Co., Fed. Rep. of Germany

[21] Appl. No.: 683,211

[22] Filed: Dec. 18, 1984

[30] Foreign Application Priority Data

Jan. 3, 1984 [DE] Fed. Rep. of Germany ..... 3400048

[51] Int. Cl.[4] ..... F22B 7/12

[52] U.S. Cl. ..... 122/149; 122/23; 122/135 F; 122/136 R; 122/182 S; 126/350 R; 165/905; 237/12.3 C

[58] Field of Search ..... 110/233, 234; 122/182 R, 182 S, 10, 14, 23, 135 F, 136 R, 149; 165/DIG. 8; 237/12.3 C; 126/360 R, 350 R

[56] References Cited

U.S. PATENT DOCUMENTS

| | | | |
|---|---|---|---|
| 3,489,209 | 1/1970 | Johnson | 165/DIG. 8 X |
| 3,776,199 | 12/1973 | Miller | 122/136 X |
| 3,779,229 | 12/1973 | Volbehr | 126/110 B |
| 3,822,690 | 7/1974 | Kofink | 126/110 B |
| 4,192,259 | 3/1980 | Viesmann | 122/136 R |
| 4,395,225 | 7/1983 | Mittmann | 431/62 |
| 4,421,069 | 12/1983 | Diggins | 122/510 X |
| 4,433,645 | 2/1984 | Smith | 122/136 R |

FOREIGN PATENT DOCUMENTS

| | | |
|---|---|---|
| 29859 | 6/1983 | European Pat. Off. . |
| 2013754 | 10/1971 | Fed. Rep. of Germany . |
| 2728827 | 5/1979 | Fed. Rep. of Germany . |
| 8009473 | 7/1980 | Fed. Rep. of Germany . |
| 2847525 | 8/1980 | Fed. Rep. of Germany . |

*Primary Examiner*—Albert J. Makay
*Assistant Examiner*—Steven E. Warner
*Attorney, Agent, or Firm*—Sixbey, Friedman & Leedom

[57] ABSTRACT

A water heater having a burner unit and a combustion chamber from which the combustion gases are discharged and deflected into an annular out-flow space through which they flow along a heat exchanger to an exhaust outlet in the area of the burner unit. The outer casing of the heat exchanger is made of plastic and together with a metal inner casing define a ring-shaped space through which water flows as a liquid heat transfer medium. The outer casing made of plastic is connected with the inner casing made of metal in a gas-tight and pressure-resistant way that is also stable with respect to temperature changes. The result is a reduction in weight of the water heater because of the formation of the outer casing of plastic, and the efficiency of the water heater can be improved by the fact that the losses through heat radiating from the outer casing can be reduced.

19 Claims, 10 Drawing Figures

FIG. 2
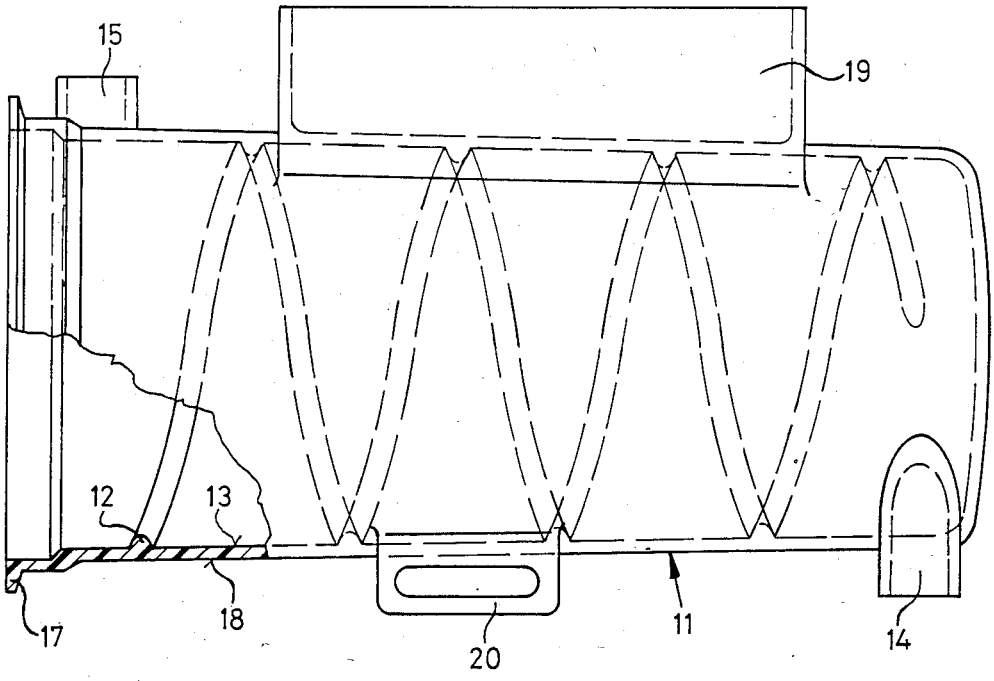
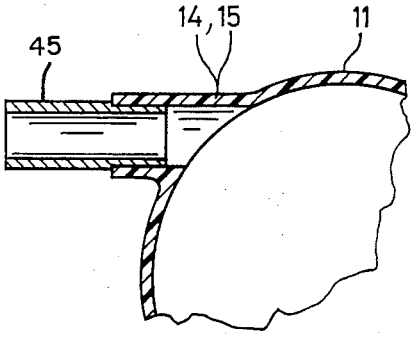
FIG. 7

WATER HEATER

BACKGROUND AND SUMMARY OF THE INVENTION

This invention relates to a water heater, particularly to a water heater for a vehicle having a burner unit and a combustion chamber surrounded by a heat exchanger so as to define an annular outflow space therebetween through which combustion gases flow to an exhaust outlet after emerging from the combustion chamber and being deflected in an opposite direction.

Water heaters of the initially mentioned type are used, preferably, as heaters or auxiliary heaters in motor vehicles. In the case of the heater transfer systems of conventional water heaters, not only the combustion tube forming the interior sheathing consists of metal, but also the exterior shell is made of steel or cast metal. As a result, the water heater, as a whole, becomes heavy, and the use of materials, such as steel or cast metal, also places limits on the shapes used for these parts because shapes have to be selected that can be manufactured cost-effectively, for example, by means of die casting. In addition, cast metals, such as steel, have a thermal conductivity that results in heat being radiated which leads to radiation losses reducing the efficiency of the whole water heater. Especially disadvantageous is the fact that the exterior shell of the water heater, which is also the exterior part of the housing, heats up during operation of the water heater and can, therefore, be installed only at correspondingly suitable locations of the motor vehicle. In most cases, surface treatments of the exterior shell are also required in order to render it passive.

On the basis of German Auslegeschrift No. 28 47 525 or European Pat. No. 0 029 859, it is known in the case of a heat exchanger for evaporators, especially for air conditioning systems, to make a connecting box for a heat exchanger for evaporators of a plastic material which takes into account the special requirements in the case of evaporators, namely a distribution of the liquid coolant or refrigerating agent that is as uniform as possible, by means of a corresponding design.

German Auslegeschrift No. 27 28 827 discloses a heat exchanger wherein a firm connection exists between the water pipes made of metal and connecting boxes made of plastic.

From German Gebrauchsmuster No. 80 09 473, a heater for motor vehicles is known having a bank of pipes delimited by two pipe plates to which a water box is connected in each case, the water boxes being made of one-piece plastic preforms.

On the basis of DE-OS No. 20 13 754, a heater is known, especially an air heater for motor vehicles, where a ring-shaped space exists, into one end of which fresh air is fed in and at an opposite closed end, the fresh air is deflected into another ring-shaped space. In this case, the casing delimiting the first ring-shaped space is formed of two shells made of plastic. Since in the case of this embodiment, the fresh air is guided along the interior surface of the halves of the shells that are made of plastic, no difficulties have to be expected in connection with excessive heating. In particular, no gas-tight, pressure-resistance connection of metal parts and plastic parts, that is also resistant to changes in temperature, is required in such an air heater because the heater does not contain any liquid, such as water, that may result in leakages, in the heater, which may make the heater useless when such liquids are used and may possibly result in damage to the motor vehicle.

Despite the above-mentioned knowledge, it was, therefore, assumed in the field of water heater construction, that the parts that come in contact with water used a heat transfer medium must be made of a generally resistant and corrosion-proof steel or cast metal in order to form the ring-shaped space through which the heat transfer medium flows and to insure that it is closed off in a gas-tight and pressure-resistant fashion. The initially described difficulties were, therefore, accepted in order to ensure a long-term reliable operation of such a water heater.

In addition, it was usually customary, as shown in U.S. Pat. No. 3,779,229, to discharge the hot combustion gases, after heat has been exchanged with the heat transfer medium, via an exhaust outlet extending through the ring-shaped space and through which the heat transfer medium flows, so that localized hot spots occur in the area of the exhaust outlet due to the temperature of the gases being exhausted. A similar result occurs where the end of the space through which the heat transfer medium flows is closed, in the area of the exhaust outlet, by a cast piece through which the combustion gases flow as in the heater shown in U.S. Pat. No. 4,395,225. Such passages will only be durable and tight if the materials that come into contact with one another have similar characteristics, so that one is forced to make the casing parts delimiting the ring-shaped space for the liquid heat transfer medium of the same material as the exhaust outlet or of a material with similar thermal properties. In the case of a water heater, it should especially be taken into account that the water, as the heat transfer medium, must be directed through the ring-shaped space of the heat transfer device below a certain working pressure so that all existing connections must be pressure-resistant and gas-tight.

Thus, the invention has a primary object of overcoming the above-described difficulties by providing a water heater of the above-mentioned type which will be suitable for large-quantity production, be of compact design, have a reduced dead weight and, especially, maintain the space through which the heat transfer medium flows reliably closed off in a gas-tight and pressure-resistant manner.

According to the invention, this is achieved by means of the heat exchanger having an outer casing made of plastic and an inner casing of metal between which the heat transfer medium flows, the inner and outer casings being connected in a manner which is gas-tight and pressure-resistant despite temperature changes.

Surprisingly, it was found that the outer casing, as a delimiting wall of the ring-shaped space through which the heat transfer medium flows, which, at the same time, forms the wall of the exterior housing of the water heater, can be manufactured of plastic so that the dead weight of such a heater can be reduced considerably. At the same time, the manufacturing of the outer casing of plastic also opens up the possibility that the shape of the outer casing can be designed more freely because construction requirements do not have to be met that exist in the case of a cast metal workpiece. In particular, it was, however, also surprisingly found that the connection of an outer casing made of plastic and an inner casing made of metal can be made to be gas-tight, pressure-resistant and stable with respect to temperature changes so that, relative to its tightness, no disadvantages have to be expected in comparison to a unit having an outer casing that is made of metal.

In the case of the invention, the use of a plastic outer casing for the heat exchanger is made possible, especially, because of the fact that the outlet for the hot combustion gases is located in the proximity of the burner unit and does not extend through the ring-shaped space between the inner and outer casings and through which water flows as the heat transfer medium, nor do the gases exit through a part closing an end of said ring-shaped space. In particular, the connection between the outer casing made of plastic and the casing made of metal is spaced from the exhaust outlet for the combustion gases so that a problem will not result at the connection as a result of an excessive development of heat, temperatures in the area of the connection being in the range that the water has as the heat transfer medium. That is, the temperature of the water as the heat transfer medium is significantly lower than the temperature of the combustion gases at the exhaust outlet so that the connecting point, in the case of the water according to the invention, is arranged in a so-called cool zone.

In addition to a considerable reduction in weight as compared to the use of an outer casing that is made of steel, the invention, by making the outer casing of plastic, also permits the outer casing to remain cooler, i.e. that lower heat losses occur through radiation and, thus, a higher efficiency is achieved for the water heater. Since the outer casing, in the case of the water heater according to the invention, is made of plastic and, therefore, heats up less than an outer casing made of metal, the development of heat by the water heater does not have to be taken into account when the water heater is installed. Also, no surface treatments are required for an outer casing that is made of plastic so that the water heater is extremely suitable for mass production because additional treatment steps, previously required, do not have to take place. Preferably, the plastic of the outer casing is a thermosetting plastic. Without surface treatments, this outer casing will then be saltwater-proof and corrosion-proof.

According to the invention, an improved efficiency of the water heater is, therefore, obtained in a constructively simple manner, and the dead weight of the water heater is, at the same time significantly reduced which is an advantage, especially, from the standpoint of installation in motor vehicles.

In accordance with preferred embodiments, the connection of the outer casing made of plastic with the inner casing made of metal are gas-tight, pressure-resistant and stable with respect to temperature changes, and the connections can in each case be adapted to the required operational conditions of the water heater. These connections are simple to manufacture as well as to assemble. In the case of the glued connection according to one embodiment, for example, drying adhesive varnishes are used which do not etch the parts to be connected with one another, and since they set because of a chemical reaction, they reliably connect the outer casing made of plastic with the inner casing made of metal.

In order to ensure a reliable sealing of the connection, either, for example, an O-ring seal may be used or a sealing paste which is applied at the contact surfaces in the area of the connection between metal and plastic casings.

The use of an outer casing of plastic leads to another surprising simplification with respect to manufacturing in that baffle plates may be developed in the shape of water-guiding webs on the inside surface of the outer plastic casing made and need not be shaped of metal at the inner casing, as previously, for reasons of casting practice. Such a development results in greater freedom of design inherent in producing plastic parts as compared to, for example, cast metal parts.

When, as according to the invention, the outer casing is made of plastic, the water inlet and outlet pieces are either molded directly onto the plastic outer casing, without resulting in manufacturing difficulties, or the inlet and outlet pieces may be manufactured separately, for example, of metal parts joined to the plastic casing during molding thereof or may be connected thereto in a manner that is similar to the connection of the plastic outer casing made of plastic to the metal inner casing.

Even if the water inlet and outlet pieces are unitarily formed of plastic with the outer casing, they can still be connected with connecting pieces made of metal, to which the connecting pipes will then be connected. In regard to the installation of this type of water heater, advantages are achieved, because, then, the connection from the hose connection and the connecting piece to the inlet and outlet piece is developed in the conventional way while pairing metal and hose-connecting materials.

Finally, the use of an outer casing made of plastic, according to the invention, also makes it possible to have additional parts molded onto its outer surface which may, for example, be used for receiving a cable harness, a cable duct, or holding means for the heater or supporting means for the heater. In addition, more openings may also be provided in the plastic outer casing without difficulties, for example, for associated parts, such as thermostats, etc.

As demonstrated, the forming of the outer casing of plastic according to the invention permits not only a considerable reduction of the dead weight of the water heater, but also other unexpected and surprising advantages that are not directly connected to the weight reduction.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 2 is a partially broken-away lateral view of an outer casing made of plastic;

FIG. 7 is a portion of the plastic outer casing in a sectional view; and

DETAILED DESCRIPTION OF THE PREFERRED EMBODIMENTS

Figure 1:
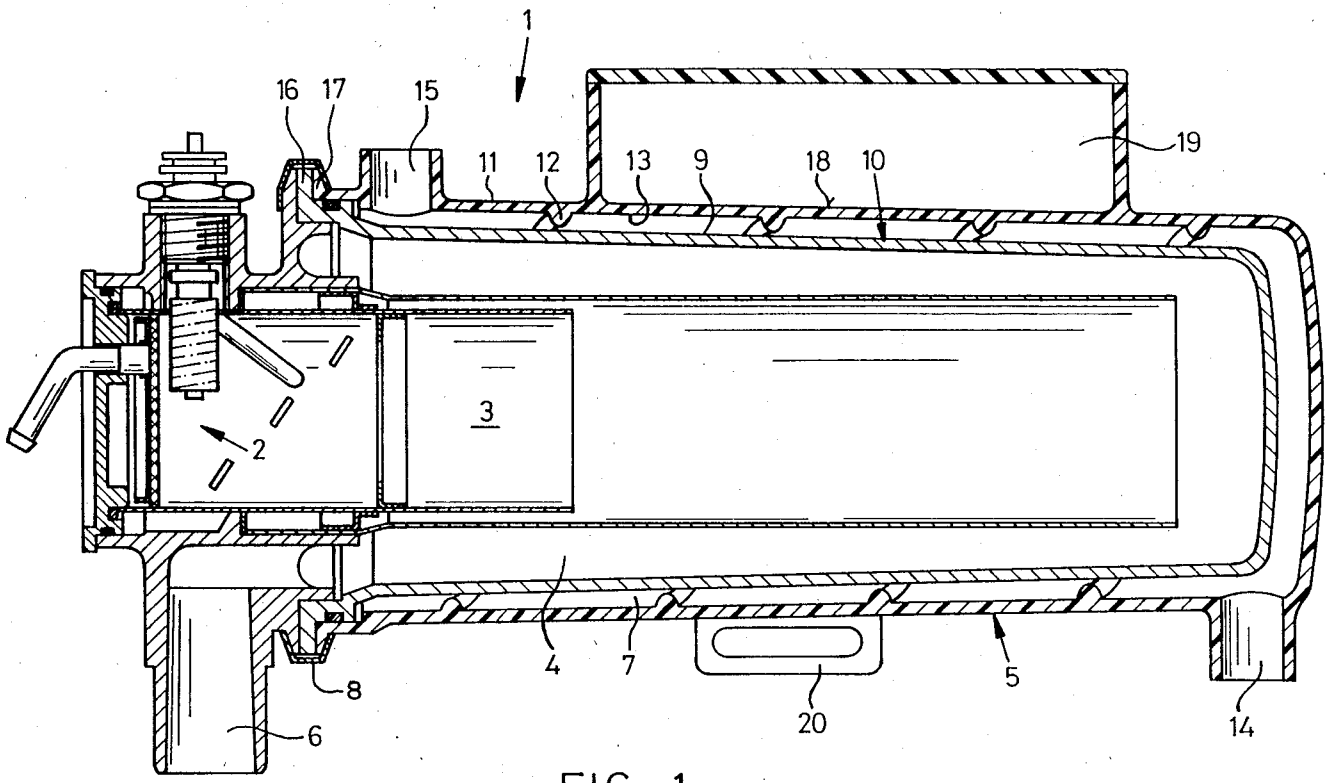
FIG. 1 is a diagrammatic, partial cross-sectional view of the whole water heater.

In FIG. 1, a water heater according to the invention is shown in diagram form, said water heater, as a whole, having the reference number 1. The water heater 1 has a burner unit projecting into a combustion chamber 3. At the end of the combustion chamber 3 that is opposite the burner unit 2, the combustion gases are deflected into an annular combustion gas space 4 wherein they flow along a heat exchanger 5. After having passed the heat exchanger 5, the combustion gases leave the water heater 1 via an exhaust outlet 6 arranged in the area of the burner unit 2. The burner unit 2, the combustion chamber 3 and the combustion gas space 4 in the drawing are shown only in diagram form and are explained in the specification only to the extent that is required in order to understand the invention, these aspects being of known design.

The heat exchanger 5 has a ring-shaped space 7 through which water flows as a heat transfer medium. The ring-shape space 7 is defined between inside casing 10 formed of metal and an outside casing 11 made of plastic. In the ring-shaped space 7, a baffle is formed by a spiral water-guiding web 12 which, according to a preferred embodiment of the invention, is unitarily molded onto the inner surface 13 of the plastic casing 11. Thus the surface 9 of the inner casing 10, bounding the ring-shaped space 7, can be formd without elevations so that manufacturing of the metal inner casing 10 is also simplified.

The heat exchanger 5, also, has an inlet piece 14 and an outlet piece 15 for the water heat transfer medium. The inner casing 10 and the outer casing 11 have flanges 16, 17 at their edge ends, by means of which the outer casing 11 and the inner casing 10 of the heat exchanger are connected in a gas-tight, pressure-resistant fashion, that is also stable with respect to temperature changes. The connection of the plastic outer casing 11 and the metal inner casing 10 will be explained in greater detail with reference to FIGS. 3 to 6.

As shown, the plastic outer casing 11, at the same time, not only is the outer wall of the heat exchanger but, forms the outer housing of the water heater 1. On the outer surface 18 of the outer casing 11, an enclosure 19 for various heater control elements may be formed, without affecting ease of manufacture. Similarly, devices for holding and supporting the heater 1 and/or other associated parts, for example, devices like thermostats, may also be provided since the plastic outer surface 18 of the outer casing 11 can, for the most part, be shaped in any manner. Therefore, the enclosure 19 and holding bracket 20 are only meant as examples. With regard to bracket 20, it is noted it may be used with an unillustrated mounting strap for fastening the water heater 1 at a suitable location of the motor vehicle by passing the strap through the slot in bracket 20.

FIG. 2 is a detailed view of the entire plastic outer casing 11. Reference numbers 14 and 15 are, respectively, the inlet and outlet pieces through which water is fed into and out of heat exchanger 5. The plastic outer casing 11 has the shape of a cup and its inner surface 13 forms a boundary wall of ring-shaped space 7 of the heat exchanger 5. In FIG. 2, the enclosure 19 and holding bracket 20 are also indicated in diagram form at the outer surface 18 of the outer casing 11.

By means of FIGS. 3 to 6, various forms for the connecton between the plastic outer casing 11 and the metal inner casing 10, that is gas-tight, pressure-resistant and stable with respect to temperature changes, are shown in detail, where the inner casing 10 is, for example, constructed as a castmetal part made of aluminum. Naturally, various aspects of the connections shown in FIGS. 3 to 6 can also be combined or exchanged with one another.

Figure 3:
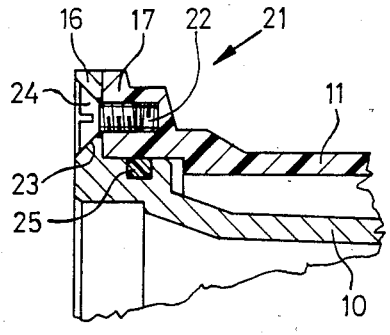
FIGS. 3 to 6 are various embodiments of connections between inner casing made of metal and the outer casing made of plastic, delimiting the ring-shaped space through which water flows as a heat transfer medium.

A screw connection 21 is shown in FIG. 3. In this case, the flange 17 of the plastic outer casing 11 has a threaded bore 22, and the flange 16 of inner casing 10 has a counter sunk hole 23 in alignment with the threaded bore 22. By means of a screw 24, the two flanges 16 and 17 are pulled against one another and are firmly connected. As also shown, an O-ring seal 25 is arranged and compressed between the inner peripheral area of the plastic outer casing 11 and outer peripheral area of the metal inner casing 10 that are in contact with one another. When the screws 24 are tightened, a pressure-resistant as well as gas-tight sealing of the ring-shaped space 7 is, thus, ensured at the connection 21. Although FIG. 3 shows only one screw at connection 21, a number of screw connections, corresponding to the requirements, may be provided, distributed evenly over the circumference of the flanges 16, 17.

Figure 4:
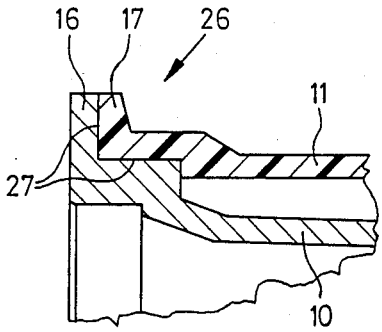

FIG. 4 shows a glued connection which as a whole has the reference number 26. In this case, the inner surfaces and the outer surfaces of the flanges 16 and 17 are provided with adhesive surfaces 27 that complement one another. A drying adhesive varnish is applied to the adhesive surfaces 27 that does not etch the parts to be connected of the plastic outer casing 11 and the metal heating pipe 10 and that sets by a chemical reaction producing a connection between inner casing 10 and the outer casing 11 that is gas-tight, pressure-resistant and stable with respect to temperature changes. Naturally, the adhesive surfaces must be selected to be so large that a secure and reliable connection is ensured between the outer casing 11 and the inner casing 10 at the adhesive surfaces 27. Furthermore, a metallic clamp ring 8 may, optionally, be secured over flanges 16, 17, as well, as shown in FIG. 1.

Figure 5:
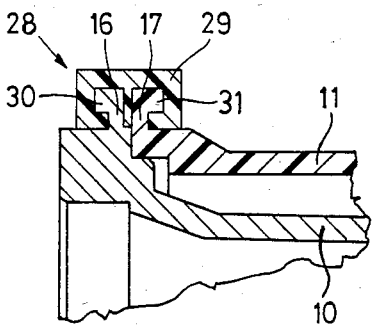

The connection in FIG. 5 has reference number 28, and in the connection 28, the flanges 16, 17 of the plastic outer casing 11 and the metal inner casing 10 are enclosed by spraying or forming a molding compound 29 thereover. In order to ensure a secure adhesion of the molding compound 29, the flanges 16, 17 have projections 30, 31 pointing in the opposite directions.

Figure 6:
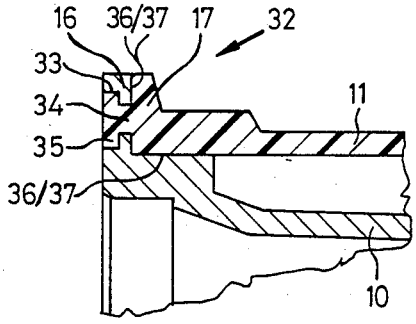

In FIG. 6 a riveted connection 32 is provided for joining the plastic outer casing 11 and the metal inner casing 10. In this case, the flange 16 of the outer casing 10 has openings 33 through which pass riveting parts 34 made of plastic which, after the fitting together, are heated and form a rivet head 35. In order to ensure a reliable sealing, sealing paste materials are applied at correspondingly facing sealing surfaces 36, 37 of the flange 16 and of the flange 17. Naturally, such a sealing paste may also be used in the case of the previously described connections. Also, the additional enclosure by means of the molding compound 29 corresponding to FIG. 5 may also be provided for an increase of the stability of the connections. Likewise, other aspects of the various connections may be combined with or exchanged with one another.

The view according to FIG. 7 shows an example of the form of the inlet piece 14 or the outlet piece 15 of the heat exchanger 5. In the case of this embodiment, the pieces 14, 15 are unitarily formed with the plastic outer casing 11. Although it is not shown, the plastic outer casing 11 may also have openings only and, during final assembly, separately manufactured parts forming the inlet piece and the outlet piece 14, 15, will then be inserted, and in the same or a similar manner as that shown in FIGS. 3 to 6, will be connected with the plastic outer casing 11. In such a case, the inlet and outlet pieces may, for example, be manufacutred as metal components. A connecting piece 45 made, for example, of metal, may also be inserted into the unitarily formed inlet and outlet pieces 14, 15 as shown in FIG. 7, and may be connected with the plastic of the inlet and outlet piece 14, 15, in a manner that is similar to that of the connections of FIGS. 3 to 6, in which case such a connecting piece is then used for the connection of the hoses. As a result, it is possible to attach the hose connections at a metal part in the conventional way.

By means of FIGS. 8, 9 and 10, other embodiments of the connection between the plastic outer casing 11 and the metal inner casing 10 will be explained. Parts that are identical or similar to those in the above-described embodiments have the same reference numbers.

Figure 8:
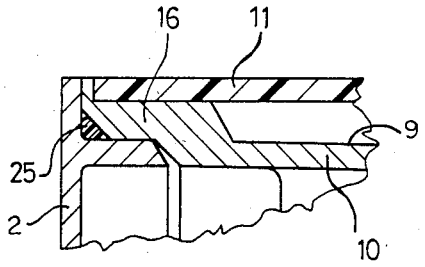
FIGS. 8 to 10 are other embodiments of connections between the metal inner casing and the plastic outer casing.

As shown in FIG. 8, the flange 16 of the metal inner casing 10 is made in the shape of a thickened ring flange in such a way that the outer circumferential area of the flange 16 of the inner casing 10 is located at about the level of the inner surface of the plastic outer casing 11. For the connection of the thus developed flange 16 of the inner casing 10 with the outer casing 11, the areas that are in contact with one another are glued together, in which case the largest part of the adhesive surface extends in parallel to the longitudinal axis of the plastic outer casing 11 and of the metal inner casing 10. For sealing purposes, an O-ring seal 25 is provided between the flange 16 and the burner unit 2. In this embodiment, it is possible that, parallel to the longitudinal axis of the outer casing 11 and of the inner casing 10, a sufficiently large adhesive surface exists and in the radial direction only the thickness of the material of the outer casing 11 made of plastic must be taken into account.

Figure 9:
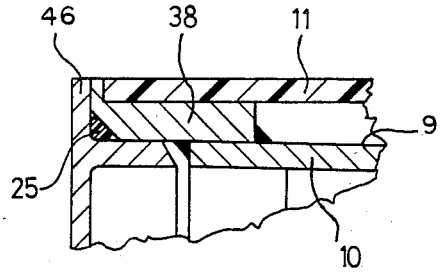

A similar type of embodiment is also shown in diagram form in FIG. 9, which, however, shows a two-piece design. On the outer surface of the metal inner-casing 10, a ring-shaped part 38 is provided between the outer surface of inner casing 10 and the inner surface of the outer casing 11. The ring-shaped part 38 is connected with the inner casing 10 by welding. This part 38 extends approximately to the level of the inner surface of the outer casing 11 so that, as in FIG. 8, a correspondingly large adhesive surface is obtained parallel to the longitudinal axis of the inner casing 10 and of the outer casing 11. As in FIG. 8, in FIG. 9, an O-ring seal 25 is provided between the ring-shaped part 38 and the flange 46 of the burner unit 2.

Figure 10:
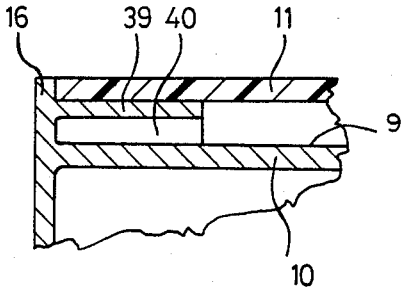

In the case of the embodiment according to FIG. 10, the flange 16 of inner casing 10 is formed in such a way, that approximately, at the level of the inner surface of the plastic outer casing 11, concentrically spaced about surface 9, a ring member 39 is formed parallel to the longitudinal axis of the casing 10 and pointing away from the burner unit 2. On this ring member 39 of the flange 16, the outer casing 11 made of plastic is glued on. Since a space 40 exists between the ring member 39 and the inner casing 10, or the material of the casing 10 has a recess, it is achieved that the glued connection of the plastic outer casing 11 to the metal inner casing 10, at the ring member 39 of the flange 16, is thermally insulated from the heat radiated from surface 9 so that the glued connection does not heat up too much.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. A water heater for a vehicle having a burner unit and a combustion chamber surrounded by a heat exchanger in a manner defining an annular out-flow space therebetween through which combustion gases flow to an exhaust outlet after emerging from the combustion chamber and being deflected in an opposite direction, said heat exchanger having an internal ring-shaped space through which a liquid heat transfer medium is circulated that is formed by an inner casing and an outer casing with an inlet piece and an outlet piece; wherein said outer casing is made of plastic and said inner casing is made of metal; wherein said inner and outer casings are joined together by flange means at an end thereof in a manner creating a gas-tight, pressure-resistant connection therebetween that is stable with respect to temperature changes resulting from use of the heater.

2. A water heater according to claim 1, wherein the flange means forming the gas-tight, pressure-resistant connection that is stable with respect to temperature changes comprises flanges formed on the inner and outer casings, said flanges being secured together with an O-ring disposed therebetween, by way of screws.

3. A water heater according to claim 1, wherein the flange means forming the gas-tight, pressure-resistant connection that is stable with respect to temperature comprises flanges formed on the inner and outer casings, said flanges being adhesively bonded together.

4. A water heater according to claim 1, wherein the flange means forming the gas-tight and pressure-resistant connection that is stable with respect to temperature changes, comprises flanges formed on the inner and outer casing, said flanges being sealingly connected together by forming an enclosure of a molding compound over the flanges.

5. A water heater according to claim 4, wherein each of said flanges is provided with a projection that points away from the other of said flanges for securely anchoring said enclosure upon the flanges.

6. A water heater according to claim 1, wherein the flange means forming the gas-tight and pressure-resistant connection that is stable with respect to temperature changes comprises flanges on the inner and outer casings, said flanges being joined together by rivets.

7. A water heater according to claim 6, wherein a sealing paste is applied between said flanges.

8. A water heater according to claim 1, wherein said rivets are formed unitarily on the flange of the plastic outer casing and are received in openings formed in the flange of the metal inner casing.

9. A water heater according to claim 1, wherein contact surfaces of the inner and outer casings, in the area of the connection therebetween, have a sealing paste applied thereto.

10. A water heater according to claim 1, wherein a baffle in the form of a water-guiding web is unitarily shaped onto an inner surface of the plastic outer casing.

11. A water heater according to claim 1, wherein the inlet and outlet pieces are molded onto the plastic outer casing.

12. A water heater according to claim 11, wherein the inlet and outlet pieces are connected with connecting pieces made of metal.

13. A water heater according to claim 1, wherein the inlet and outlet pieces are separately manufactured pieces that are mounted to the outer casing in the manner of said flange means.

14. A water heater according to claim 1, wherein at least one of an enclosure for heater control elements and means for mounting of the heater are unitarily formed on the plastic outer casing.

15. A water heater according to claim 1, wherein the flange means comprises a flange on the inner casing that includes a ring-shaped part or member that is provided in such a way that an inner surface of the outer casing is glued onto an outer surface of the flange that extends parallel to the longitudinal axis of the heater.

16. A water heater according to claim 15, wherein the ring-shaped part is a separate component that is welded onto the inner casing.

17. A water heater according to claim 15, wherein a space exists between the ring-shaped member and an outer surface of the heating pipe for purposes of heat insulation.

18. A water heater according to claim 15, wherein an O-ring seal is provided between said ring-shaped part or member and a flange of the burner unit.

19. A water heater according to claim 15, wherein said ring-shaped part or member has a radially extending lip against which an end surface of the outer casing engages.

* * * * *